US010094318B2

(12) United States Patent
Yamanaka et al.

(10) Patent No.: US 10,094,318 B2
(45) Date of Patent: Oct. 9, 2018

(54) INTERNAL COMBUSTION ENGINE CONTROL DEVICE AND METHOD FOR CONTROLLING FUEL INJECTION VALVE OF INTERNAL COMBUSTION ENGINE

(71) Applicant: HONDA MOTOR CO., LTD., Tokyo (JP)

(72) Inventors: Tatsuo Yamanaka, Wako (JP); Susumu Nakajima, Wako (JP); Naoki Yokoyama, Wako (JP); Kenji Hirose, Wako (JP); Hidekazu Hironobu, Wako (JP); Seiichi Hosogai, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/682,448

(22) Filed: Aug. 21, 2017

(65) Prior Publication Data

US 2018/0112615 A1 Apr. 26, 2018

(30) Foreign Application Priority Data

Oct. 26, 2016 (JP) ..... 2016-210026

(51) Int. Cl.

*F02D 41/24* (2006.01)
*F02D 41/34* (2006.01)
*F02D 41/20* (2006.01)

(52) U.S. Cl.

CPC ..... *F02D 41/2467* (2013.01); *F02D 41/34* (2013.01); *F02D 2041/2051* (2013.01); *F02D 2041/2055* (2013.01); *F02D 2041/2058* (2013.01)

(58) Field of Classification Search

CPC ..... F02D 41/24; F02D 41/2467; F02D 41/34; F02D 2041/2051; F02D 2041/2055; F02D 2041/2058

See application file for complete search history.

(56) References Cited

U.S. PATENT DOCUMENTS 9,745,913 B2 * 8/2017 Fujime ..... F02D 41/3005

FOREIGN PATENT DOCUMENTS

JP 5474178 B2 10/2012

* cited by examiner

*Primary Examiner* — Hieu T Vo
(74) *Attorney, Agent, or Firm* — Mori & Ward, LLP

(57) ABSTRACT

An internal combustion engine control device to control a fuel injection valve includes: valve-close delay time acquisition circuitry configured to acquire a valve-close delay time of the fuel injection valve; first learning value calculation circuitry configured to calculate a first learning value based on the valve-close delay time when a running state of an internal combustion engine satisfies a predetermined learning condition; valve-open time calculation circuitry configured to calculate a valve-open time of the fuel injection valve based on the first learning value; second learning value calculation circuitry configured to calculate a second learning value based on the valve-close delay time irrespective of the running state of the internal combustion engine; and learning state determination circuitry configured to determine a learning state of the first learning value based on a relationship between the first learning value and second learning value.

12 Claims, 9 Drawing Sheets

INTERNAL COMBUSTION ENGINE CONTROL DEVICE AND METHOD FOR CONTROLLING FUEL INJECTION VALVE OF INTERNAL COMBUSTION ENGINE

CROSS-REFERENCE TO RELATED APPLICATIONS

The present application claims priority under 35 U.S.C. § 119 to Japanese Patent Application No. 2016-210026, filed Oct. 26, 2016, entitled "Internal Combustion Engine Control Device." The contents of this application are incorporated herein by reference in their entirety.

BACKGROUND

1. Field

The present disclosure relates to an internal combustion engine control device and a method for controlling a fuel injection valve of an internal combustion engine.

2. Description of the Related Art

The device described by Japanese Patent No. 5474178, for example, is a known conventional internal combustion engine control device. The control device detects a timing at which an electromagnetic fuel injection valve of an internal combustion engine actually closes (referred to as the actual closing timing hereafter), and the detection is performed as follows. A voltage applied to a magnetic coil during operation of the fuel injection valve is detected as an actuator voltage, and a first-order derivative value of the detected actuator voltage is computed. A timing at which the first-order derivative value is a minimum value is then detected as the actual closing timing of the fuel injection valve based on a relationship in which the first-order derivative value of the actuator voltage reaches the minimum value when a valve needle of the fuel injection valve contacts a valve seat.

SUMMARY

According to one aspect of the present invention, an internal combustion engine control device controls a quantity of fuel injected from a fuel injection valve having a valve-close delay time spanning from receipt of a valve-close instruction until actually closing, the internal combustion engine control device including: a valve-close delay time acquisition unit that acquires the valve-close delay time; a first learning value computation unit that, when a predetermined learning condition based on a running state of the internal combustion engine has been established, based on the acquired valve-close delay time computes a first learning value for control; a valve-open time computation unit that uses the computed first learning value to compute a valve-open time of the fuel injection valve; a second learning value computation unit that based on the acquired valve-close delay time always computes a second learning value for determination irrespective of whether or not the predetermined learning condition is established; and a learning state determination unit that determines a learning state of the first learning value based on a relationship between the computed first learning value and second learning value.

According to another aspect of the present invention, an internal combustion engine control device to control a fuel injection valve includes: valve-close delay time acquisition circuitry configured to acquire a valve-close delay time of the fuel injection valve; first learning value calculation circuitry configured to calculate a first learning value based on the valve-close delay time when a running state of an internal combustion engine satisfies a predetermined learning condition; valve-open time calculation circuitry configured to calculate a valve-open time of the fuel injection valve based on the first learning value; second learning value calculation circuitry configured to calculate a second learning value based on the valve-close delay time irrespective of the running state of the internal combustion engine; and learning state determination circuitry configured to determine a learning state of the first learning value based on a relationship between the first learning value and second learning value.

According to further aspect of the present invention, an internal combustion engine control device to control a fuel injection valve includes: valve-close delay time acquisition means for acquiring a valve-close delay time of the fuel injection valve; first learning value calculation means for calculating a first learning value based on the valve-close delay time when a running state of an internal combustion engine satisfies a predetermined learning condition; valve-open time calculation means for calculating a valve-open time of the fuel injection valve based on the first learning value; second learning value calculation means for calculating a second learning value based on the valve-close delay time irrespective of the running state of the internal combustion engine; and learning state determination means for determining a learning state of the first learning value based on a relationship between the first learning value and second learning value.

According to further aspect of the present invention, a method for controlling a fuel injection valve of an internal combustion engine includes: acquiring a valve-close delay time of the fuel injection valve; calculating a first learning value based on the valve-close delay time when a running state of an internal combustion engine satisfies a predetermined learning condition; calculating a valve-open time of the fuel injection valve based on the first learning value; calculating a second learning value based on the valve-close delay time irrespective of the running state of the internal combustion engine; and determining a learning state of the first learning value based on a relationship between the first learning value and second learning value.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
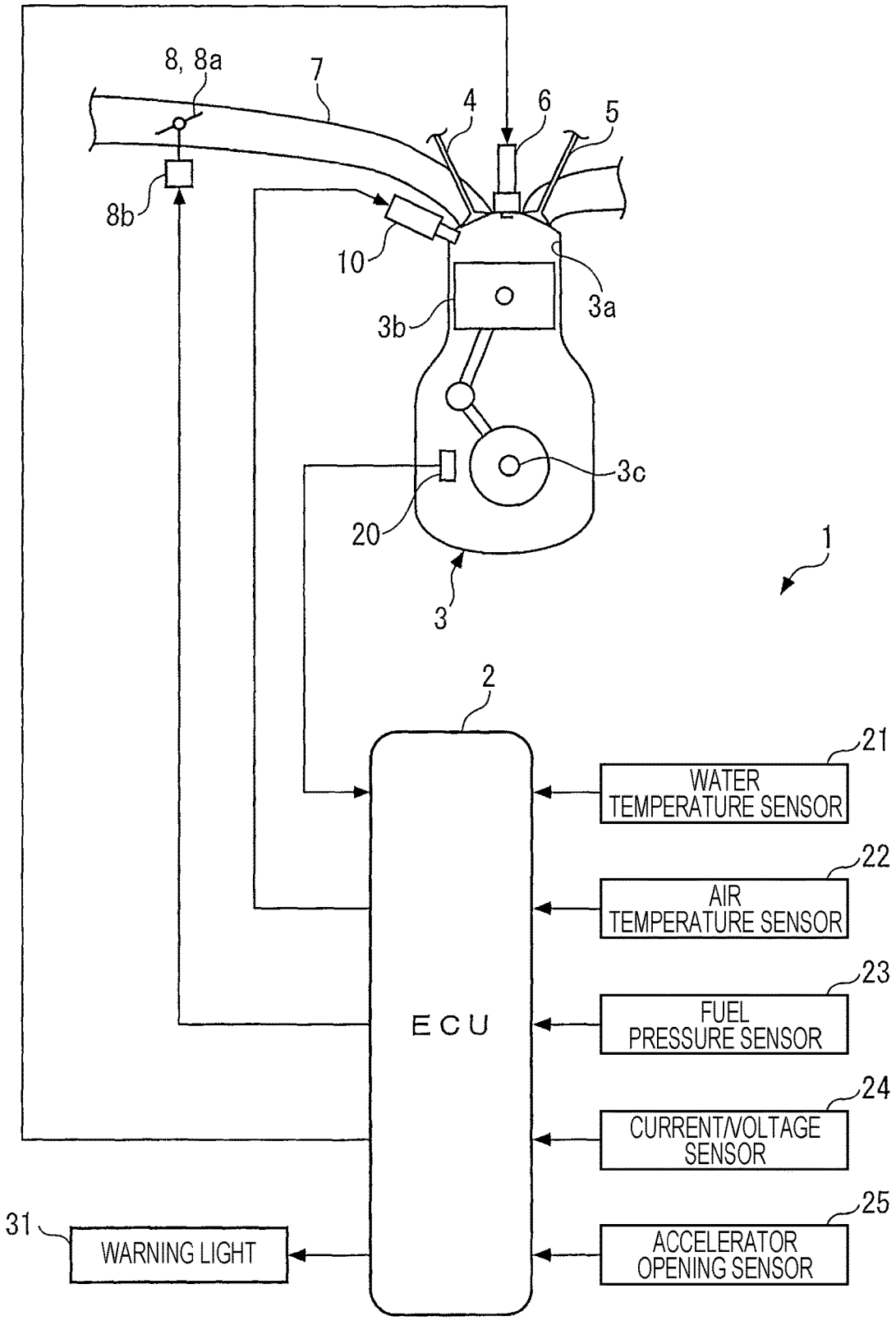
FIG. 1 is a diagram schematically illustrating a configuration of a control device and an internal combustion engine with the control device, according to an embodiment of the present disclosure.

The embodiments will now be described with reference to the accompanying drawings, wherein like reference numerals designate corresponding or identical elements throughout the various drawings.

An internal combustion engine control device according to one embodiment of the present disclosure is described below, with reference to the drawings. As illustrated in FIG. 1, a control device 1 of the disclosure includes an ECU 2. As described later, the ECU 2 executes various control processing in an internal combustion engine 3 (referred to as an engine hereafter).

The engine 3 is, for example, a gasoline engine having four cylinders 3*a* and pistons 3*b* (only one of each is illustrated) installed in a non-illustrated vehicle. Each cylinder 3*a* includes an air intake valve 4, an exhaust valve 5, a spark plug 6, and a fuel injection valve 10. An ignition timing IG of the spark plug 6 is controlled by the ECU 2.

The fuel injection valve 10 is provided such that a leading end portion thereof faces into the cylinder 3*a*, and the fuel injection valve 10 is connected to a delivery pipe, a fuel pump, and the like of a fuel supply device (none of which are illustrated). When the engine 3 is running, high pressure fuel is supplied to the fuel injection valve 10 through the delivery pipe and is injected into the cylinder 3*a* by opening the fuel injection valve 10.

Figure 2A:
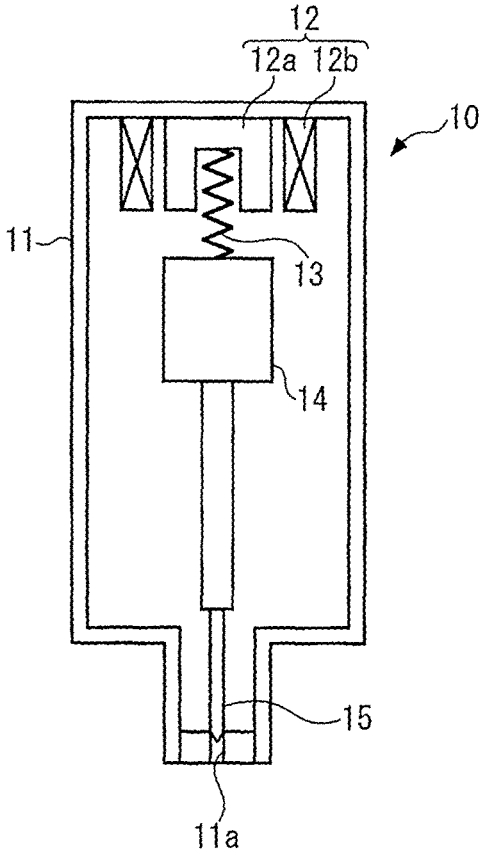
FIG. 2A is a diagram schematically illustrating a configuration of a fuel injection valve and an operation state of the fuel injection valve when closed.
Figure 2B:
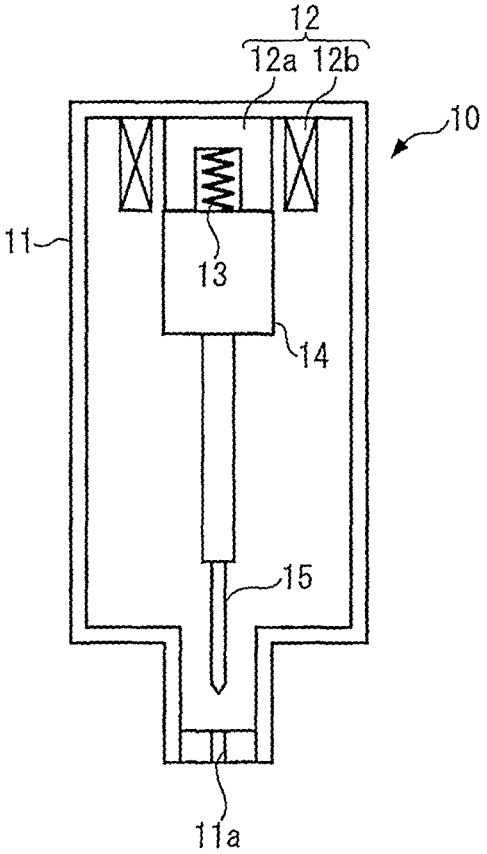
FIG. 2B is a diagram schematically illustrating a configuration of a fuel injection valve and an operation state of the fuel injection valve when open.

As illustrated in FIG. 2A and FIG. 2B, the fuel injection valve 10 includes a casing 11, an electromagnet 12, a spring 13, an armature 14, a valve body 15, and the like. The electromagnet 12 is provided on the inner side of a top wall of the casing 11, and is configured by a yoke 12*a* and a coil (solenoid) 12*b* wound around the outer periphery of the yoke 12*a*. The coil 12*b* is electrically connected to the ECU 2 via a drive circuit (not illustrated), and supplying/stopping current to the coil 12*b* is controlled by inputting/stopping a valve-open instruction signal from the ECU 2, thereby switching the electromagnet 12 between excited and non-excited states.

Further, the spring 13 is disposed between the yoke 12*a* of the electromagnet 12 and the armature 14, and constantly urges the valve body 15 toward the closed side via the armature 14. This urging by the spring 13 when the electromagnet 12 is in a non-excited state retains the valve body 15 in a state where an injection hole 11*a* of a leading end portion of the casing 11 is closed off by the valve body 15, thereby retaining the fuel injection valve 10 in a closed state (the state of FIG. 2A).

According to the above configuration, in the fuel injection valve 10, when a valve-open instruction signal is input from the ECU 2 and the electromagnet 12 is excited, the armature 14 is drawn to the yoke 12*a* side against the urging force of the spring 13. Accompanying this action, the valve body 15 moves toward the yoke 12*a* side and the fuel injection valve 10 opens by opening up the injection hole 11*a* (the state of FIG. 2B). Hereafter, the amount of movement toward the yoke 12*a* side by the valve body 15 is referred to as the lift of the fuel injection valve 10. From this open state, when input of the valve-open instruction signal is stopped and the electromagnet 12 switches to a non-excited state, the fuel injection valve 10 is closed by the urging force of the spring 13.

Figure 3A:
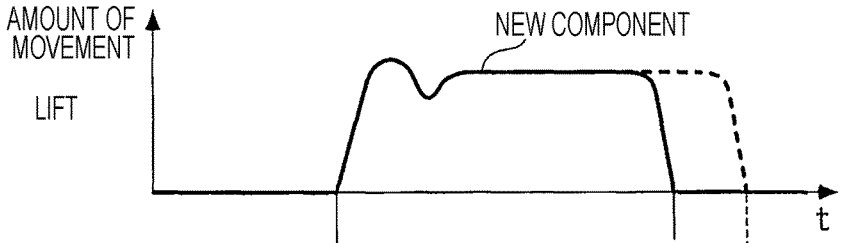
FIG. 3A and FIG. 3B are timing charts illustrating a relationship between lift and a valve-open instruction signal when a fuel injection valve is a new component or a used component.
Figure 3B:
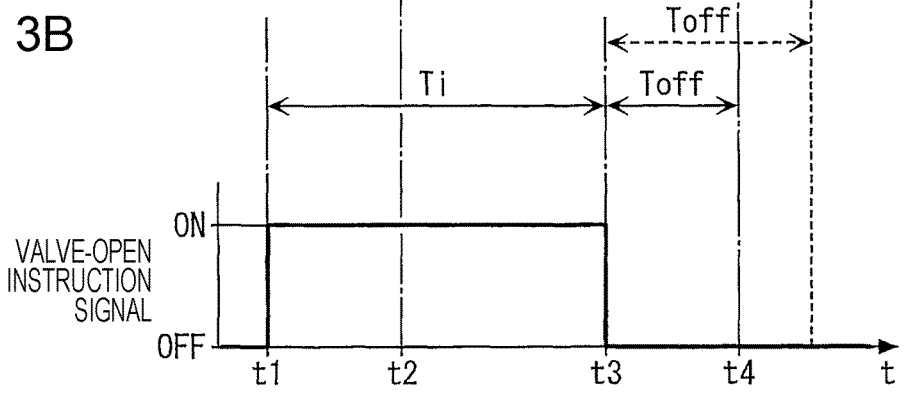

FIG. 3A and FIG. 3B illustrate such a relationship between input/stopping of the valve-open instruction signal and the actual opening/closing operation of the fuel injection valve 10 that results. In the diagram, Ti is the valve-open time of the fuel injection valve 10 (the input time of the valve-open instruction signal) computed as described later. As illustrated in the same diagram, when the valve-open instruction signal is input at timing t1, movement of the valve body 15 toward the yoke 12*a* side and an increase in the lift begin at a timing t2, which is delayed from the timing t1 as a result of the response delay characteristics of the fuel injection valve 10.

Then, when input of the valve-open instruction signal stops at a timing (timing t3) at which the valve-open time Ti has elapsed since the input timing of the valve-open instruction signal, the lift decreases as a result of the valve body 15 being moved toward the closed side by the urging force of the spring 13, and at a timing t4, the value of the lift becomes 0 and the fuel injection valve 10 adopts a fully closed state. As described below, the time spanning from the input stop timing of the valve-open instruction signal until the value of the lift actually becomes 0 (from t3 to t4) is referred to as the valve-close delay time Toff.

Further, since the closing operation of the fuel injection valve 10 is dependent on the urging by the spring 13, the valve-close delay time Toff has a characteristic of gradually extending with age as the spring 13 deteriorates with age and the spring constant drops. As a result, even when the valve-open time Ti of the valve-open instruction signal is the same, the actual valve-open time is longer in the case of a used component (the dashed line in FIG. 3A and FIG. 3B) than in the case of a new component (the solid line), and excess fuel is injected. As described later, in the present embodiment, a valve-close delay time Toff having such characteristics is acquired and learned, and the valve-open time Ti is computed using the learning result.

Further, an air intake channel 7 of the engine 3 includes a throttle valve mechanism 8. The throttle valve mechanism 8 is configured by a throttle valve 8*a*, a TH actuator 8*b* that drives the opening and closing of the throttle valve 8*a*, and the like. An opening amount TH of the throttle valve 8*a* (referred to as the throttle valve opening amount hereafter) is controlled via the TH actuator 8*b* in accordance with a drive signal from the ECU 2, and this controls the amount of air flowing through the throttle valve 8*a*.

A crank angle sensor 20, a water temperature sensor 21, an air temperature sensor 22, a fuel pressure sensor 23, a current/voltage sensor 24, and an accelerator opening sensor 25 are electrically connected to the ECU 2, and their detection signals are input to the ECU 2.

As a crankshaft 3*c* rotates, the crank angle sensor 20 outputs a CRK signal and a TDC signal, which are pulse signals. The CRK signal is output at predetermined crank angles (for example, every 30°). The ECU 2 computes a revolution rate NE (referred to as engine revolutions hereafter) of the engine 3 based on the CRK signal.

The TDC signal is a signal indicating that the piston 3*b* in one of the cylinders 3*a* is in a crank angle position slightly to the lag-angle side of the top dead center (air intake TDC) where an air intake process begins. In cases in which the engine 3 has four cylinders, as in the present embodiment, the TDC signal is output at every 180° of the crank angle. The ECU 2 computes a crank angle CA for each cylinder 3*a* based on the TDC signal, the CRK signal, and the like.

Further, the water temperature sensor 21 detects an engine water temperature TW that is a temperature of coolant water circulating in a cylinder block of the engine 3, the air temperature sensor 22 detects an air temperature TA, and the fuel pressure sensor 23 detects a fuel pressure PF that is the fuel pressure inside the delivery pipe. Furthermore, the current/voltage sensor 24 detects a voltage Vinj across both terminals of the electromagnet 12 of the fuel injection valve 10 (referred to as the solenoid voltage hereafter), and a current Iinj flowing through the electromagnet 12 (referred to as the solenoid current hereafter). Further, the accelerator opening sensor 25 detects a press-amount AP of an accelerator pedal (not illustrated) of the vehicle (referred to as an accelerator opening hereafter).

Furthermore, a control panel of a driver seat of the vehicle includes a warning light 31 for warning of a situation in which the level of learning of the valve-close delay time of the fuel injection valve 10, described later, is low. The operation of the warning light 31 is controlled by the ECU 2.

The ECU 2 is configured by a microcomputer that includes a CPU, RAM, ROM, $E^2$PROM, an I/O interface, and the like (none of which are illustrated). The ECU 2 controls operation of the spark plug 6, the fuel injection valve 10, and the like in accordance with the detection signals of the various sensors 20 to 25 described above, and executes various control processing, described later.

In the present embodiment, the ECU 2 corresponds to a valve-close delay time acquisition unit, a first learning value computation unit, a valve-open time computation unit, a second learning value computation unit, a learning state determination unit, and a running state controlling unit.

Next, fuel injection control processing executed by the ECU 2 is described, with reference to FIG. 4 to FIG. 7. The fuel injection control processing is executed for each cylinder 3*a* (each fuel injection valve 10) in synchronization with generation of the TDC signal.

Figure 4:
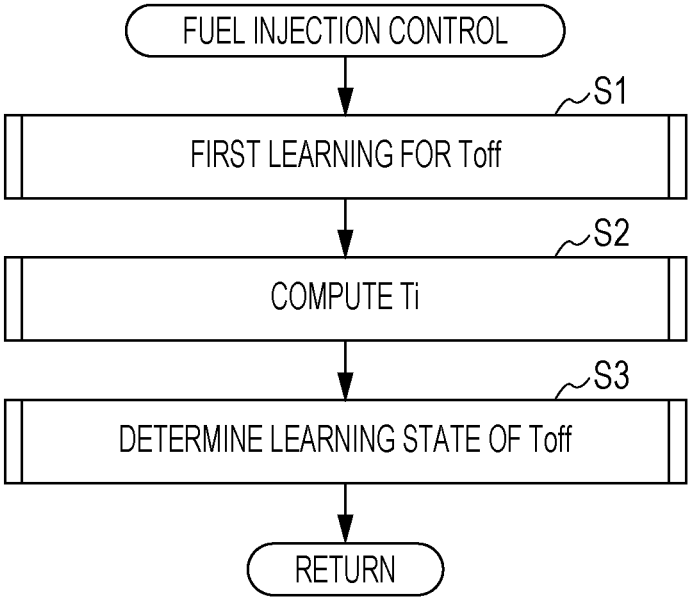
FIG. 4 is a flowchart illustrating a main flow of fuel injection control processing.

FIG. 4 illustrates a main flow of the fuel injection control processing. In the present processing, first, first learning processing for the valve-close delay time Toff of the fuel injection valve 10 is executed at step 1 ("S1" in the drawings; similar applies below). In the first learning processing, a first learning value Toff_LRN1 for controlling the fuel injection valve 10 is computed as a learning value of the valve-close delay time Toff when predetermined learning conditions have been established based on a specific running state of the engine 3.

Next, at step 2, computation processing for the valve-open time Ti of the fuel injection valve 10 (the input time of the valve-open instruction signal) is executed. This computation processing computes the valve-open time Ti using the first learning value Toff_LRN1 computed at step 1.

Next, at step 3, determination processing for the learning state of the valve-close delay time Toff is executed, and the processing of FIG. 4 ends. In order to determine the learning value of the valve-close delay time Toff, the determination processing always computes the second learning value Toff_LRN2 for determination of the learning state and determines the level of learning of the first learning value Toff_LRN1 based on a result of comparing against the second learning value Toff_LRN2. Details of processing of steps 1 to 3, mentioned above, are described below, with reference to FIG. 5 to FIG. 7 respectively.

Figure 5:
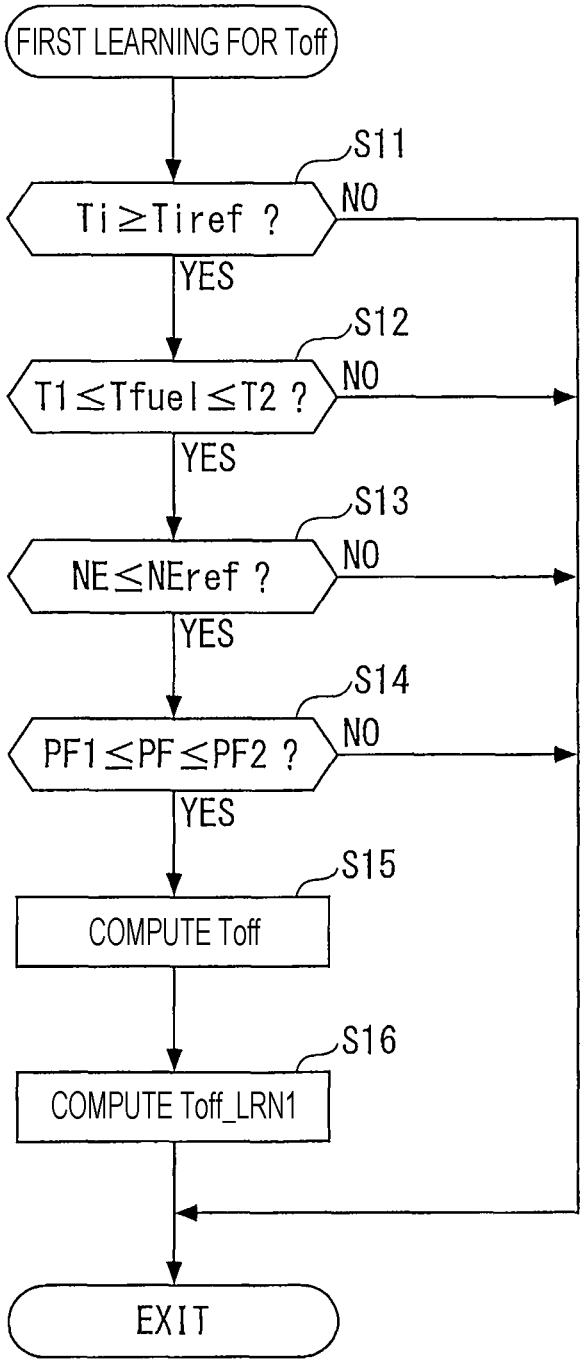
FIG. 5 is a flowchart illustrating a subroutine of first learning processing for a valve-close delay time.

FIG. 5 illustrates a subroutine of the first learning processing executed at step 1 above. In the present processing, at steps 11 to 14, it is determined whether or not the learning conditions for the valve-close delay time Toff (a computation condition of the first learning value Toff_LRN1) are established.

More specifically, first, at step 11, determination is made as to whether or not the valve-open time Ti of the fuel injection valve 10 the previous time was in a predetermined time range that is a predetermined value Tiref or greater (Ti≥Tiref). This time range is set as a region in which the solenoid current Iinj flowing through the electromagnet 12 is stable and the accompanying valve-close delay time Toff is also stable, since the valve-open time Ti is comparatively long. Accordingly, when the determination result of step 11 is NO, the valve-close delay time Toff may be unstable due to the valve-open time Ti being insufficient, and it is therefore determined that the learning conditions for the valve-close delay time Toff are not established and the present processing ends as-is.

When the determination result of step 11 is YES, processing proceeds to step 12 and determination is made as to whether or not the fuel temperature Tfuel is in a predetermined temperature range defined by first and second predetermined values T1 and T2 (T1≤Tfuel≤T2). The fuel temperature Tfuel is computed by retrieval from a predetermined map (not illustrated) in accordance with the engine water temperature TW and the air temperature TA. Further, the temperature range is set as a region in which changes in viscosity of the fuel with fuel temperature do not cause an excessive amount of change in the valve-close delay time Toff. Accordingly, when the determination result of step 12 is NO, fuel temperature may cause an excessive amount of change in the valve-close delay time Toff, and it is therefore determined that the learning conditions are not established and the present processing ends as-is.

When the determination result of step 12 above is YES, processing proceeds to step 13 and determination is made as to whether or not the engine revolutions NE is in a predetermined revolution range that is a predetermined value NEref or lower (NE≤NEref). This revolution range is set as a region in which the valve-close delay time Toff is stable since fuel pressure pulsations in the delivery pipe, which are liable to be generated when revolutions are high, are avoided. Accordingly, when the determination result of step 13 is NO, generation of pulsations may make the valve-close delay time Toff unstable, and it is therefore determined that the learning conditions are not established and the present processing ends as-is.

When the determination result of step 13 above is YES, processing proceeds to step 14 and determination is made as to whether or not the fuel pressure PF is in a predetermined pressure range defined by first and second predetermined values PF1 and PF2 (PF1≤PF≤PF2). This pressure range is set as a region in which changes to fuel pressure do not cause an excessive amount of change in the valve-close delay time Toff. Accordingly, when the determination result of step 14 is NO, fuel pressure may cause an excessive amount of change in the valve-close delay time Toff, and it is therefore determined that the learning conditions are not established and the present processing ends as-is.

On the other hand, when the determination result of step 14 above is YES, it is determined that the learning conditions for the valve-close delay time Toff are established, processing proceeds to step 15, and the valve-close delay time Toff is computed. The computation of the valve-close delay time Toff is, for example, performed by the following method. Namely, a first-order derivative value of the solenoid voltage Vinj of the fuel injection valve 10 is computed and a peak position thereof is detected as an actual closing timing at which the fuel injection valve 10 actually closed. Then, a time spanning from the stop timing of the valve-open instruction signal until the actual closing timing is computed, and the valve-close delay time Toff is computed by correcting this time for the fuel temperature Tfuel.

Next, processing proceeds to step 16, the computed valve-close delay time Toff is used to compute the first learning value Toff_LRN1 of the valve-close delay time according to Equation (1) below, and the present processing ends.

$$Toff_LRN1=Gain1\cdot Toff+(1-Gain1)\cdot Toff_LRN1 \quad (1)$$

Here, Toff_LRN1 at the right side is the previous value of the first learning value, and Gain1 is a predetermined first smoothing coefficient (0<Gain1<1). As is clear from Equation (1), the smaller the first smoothing coefficient Gain1, the greater the level of smoothing on the computed valve-close delay time Toff. Further, the first smoothing coefficient Gain1 is set to a comparatively small value within the above range such that the level of smoothing is great.

Figure 6:
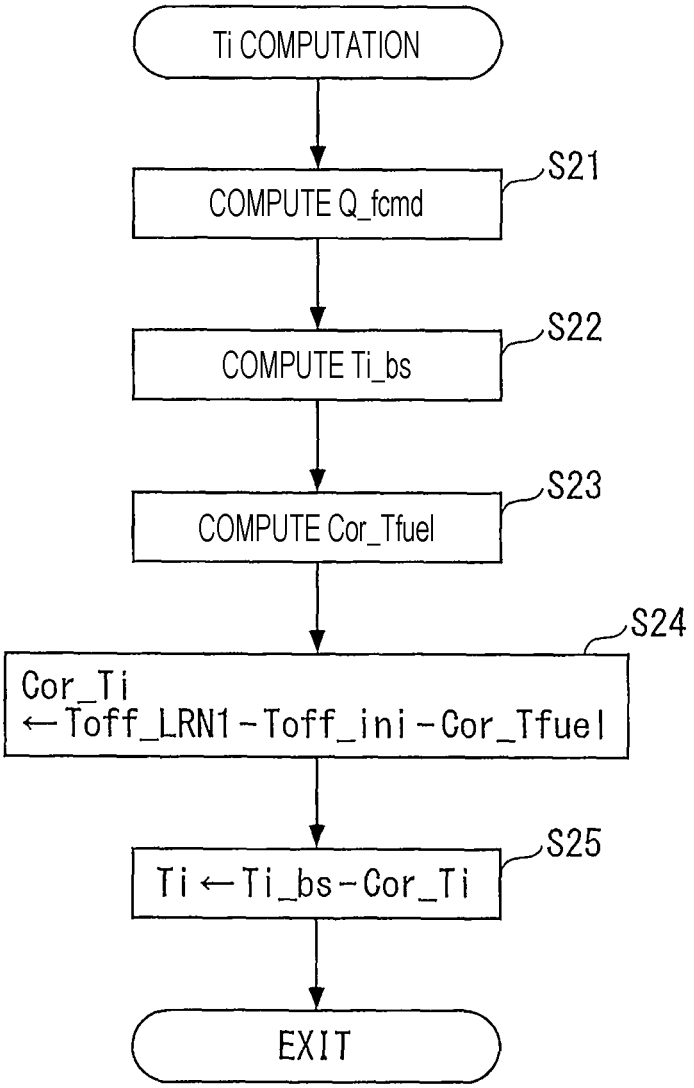
FIG. 6 is a flowchart illustrating a subroutine of computation processing for a valve-open time of a fuel injection valve.

FIG. 6 illustrates a subroutine of the computation processing for the valve-open time Ti executed at step 2 of FIG. 4. In the present processing, first, at step 21, a demanded fuel quantity Q_fcmd demanded by the fuel injection valve 10 is computed. The demanded fuel quantity Q_fcmd is computed by retrieval from a predetermined map (not illustrated) in accordance with a demanded torque TRQ and the engine revolutions NE. Further, the demanded torque TRQ is computed by retrieval from a predetermined map (not illustrated) in accordance with the accelerator opening AP and the engine revolutions NE.

Next, processing proceeds to step 22 and a base value Ti_bs of the valve-open time Ti is computed by retrieval from a predetermined map (not illustrated) in accordance with the computed demanded fuel quantity Q_fcmd and the fuel pressure PF.

Next, at step 23, a temperature correction value Cor_Tfuel is computed. The computation of the temperature correction value Cor_Tfuel is performed by retrieval from a predetermined map (not illustrated) in accordance with the fuel temperature Tfuel.

Next, processing transitions to step 24 and the first learning value Toff_LRN1 and the temperature correction value Cor_Tfuel are used to compute a valve-open time correction value Cor_Ti according to Equation (2) below.

$$Cor_Ti=Toff_LRN1-Toff_ini-Cor_Tfuel \quad (2)$$

Here, Toff_ini at the right side is an initial value of the valve-close delay time Toff, and is computed when the vehicle is shipped in a state where there are established conditions that are substantially the same as the learning conditions for the first learning value Toff_LRN1 described above (steps 11 to 14 of FIG. 5). The computed Toff_ini is stored in $E^2$PROM. Accordingly, the difference between the first learning value Toff_LRN1 at the right side and the initial value Toff_ini (=Toff_LRN1−Toff_ini) represents the amount of change (shift) in the valve-close delay time Toff with age from when the vehicle was shipped. Further, the temperature correction value Cor_Tfuel is used for applying corrections in accordance with the current fuel temperature Tfuel.

Next, processing then transitions to step 25 and the valve-open time Ti is computed according to Equation (3) below by subtracting the valve-open time correction value Cor_Ti from the base value Ti_bs computed at step 22, and the present processing ends.

$$Ti=Ti_bs-Cor_Ti \quad (3)$$

During the valve-open time Ti computed as described above, a fuel injection quantity Qfuel, which is injected from the fuel injection valve 10 by outputting the valve-open instruction signal to the fuel injection valve 10, is controlled so as to be the demanded fuel quantity Q_fcmd.

Figure 7:
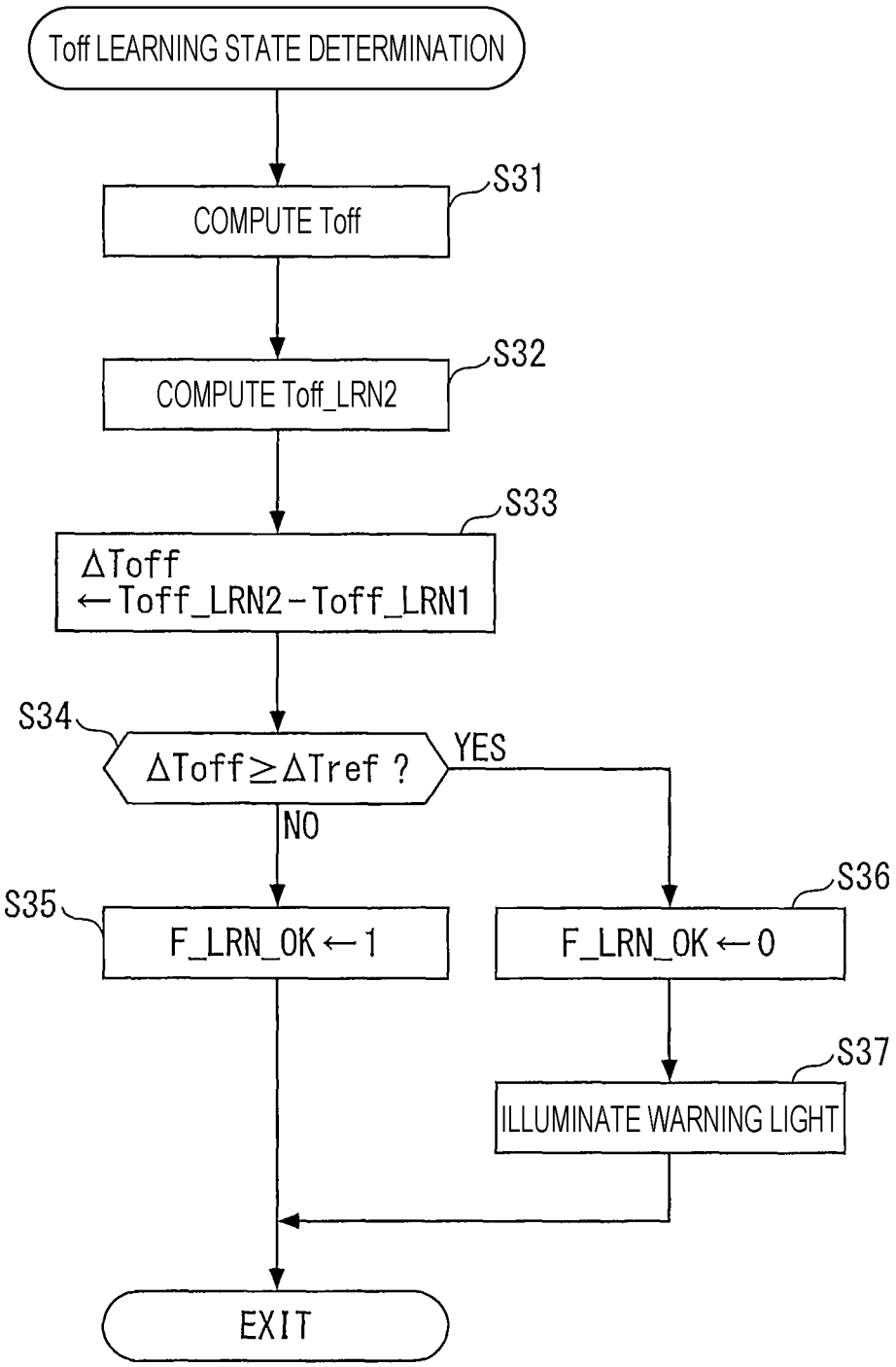
FIG. 7 is a flowchart illustrating a subroutine of learning conditions determination processing for a valve-close delay time.

FIG. 7 illustrates a subroutine of learning state determination processing for the valve-close delay time Toff executed at step 3 of FIG. 4. In the present processing, first, at step 31, the valve-close delay time Toff is computed by the same method as at step 15 of FIG. 5 described above.

Next, processing proceeds to step 32 and the computed valve-close delay time Toff is employed to compute the second learning value Toff_LRN2 for the valve-close delay time according to Equation (4) below.

$$Toff_LRN2=Gain2\cdot Toff+(1-Gain2)\cdot Toff_LRN2 \quad (4)$$

Here, Toff_LRN2 at the right side is the previous value of the second learning value. Further, Gain2 is a predetermined second smoothing coefficient (0<Gain2<1), and is set to a greater value than the first smoothing coefficient Gain1 employed in the computation of the first learning value Toff_LRN1 described above. Namely, Gain2 is set such that the level of smoothing is lower.

Further, as described above, unlike the first learning value Toff_LRN1, the second learning value Toff_LRN2 is always computed each time the processing of FIG. 7 is executed, namely, each time the fuel injection valve 10 operates, irrespective of whether or not the predetermined learning conditions (steps 11 to 14 of FIG. 5) are established.

Next, at step 33, the difference between the second learning value Toff_LRN2 and the first learning value Toff_LRN1 is computed as a learning value difference ΔToff. Next, at step 34, determination is made as to whether or not the learning value difference ΔToff is a predetermined determination value ΔTref or above. When the determination result is NO and ΔToff<ΔTref, it is determined that the level of learning of the first learning value Toff_LRN1 is high and that adequate learning of the first learning value Toff_LRN1 is being performed, since the level of divergence of the first learning value Toff_LRN1 from the second learning value Toff_LRN2 is low. A valve-close delay time learned flag F_LRN_OK is then set to "1" (step 35) to express this, and the present processing ends.

On the other hand, when the determination result of step 34 above is YES and ΔToff_ΔTref, it is determined that the level of learning of the first learning value Toff_LRN1 is low and that adequate learning of the first learning value Toff_LRN1 is not being performed, since the level of divergence of the first learning value Toff_LRN1 from the second learning value Toff_LRN2 is great. Then, the valve-close delay time learned flag F_LRN_OK is set to "0" (step 36), the warning light 31 is illuminated to inform the driver of the situation (step 37), and the present processing ends.

Figure 8:
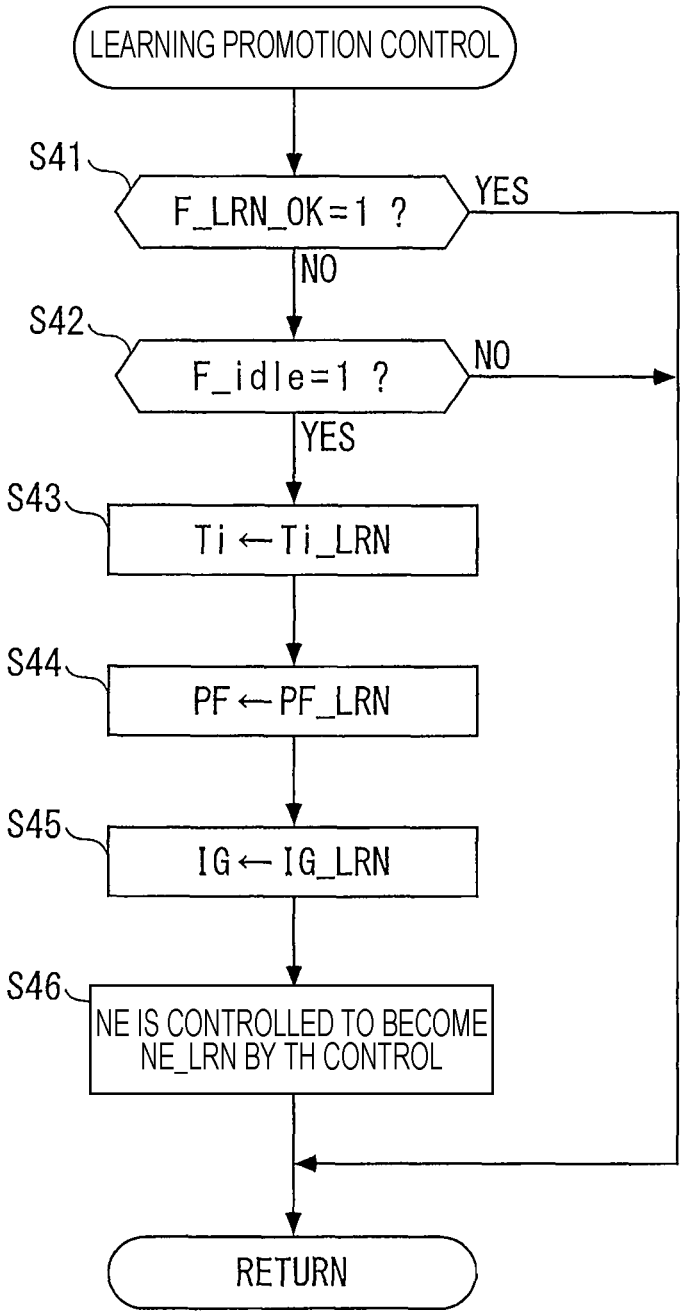
FIG. 8 is a flowchart illustrating learning promotion control processing.

FIG. 8 illustrates learning promotion control processing executed in accordance with the above determination result. In cases in which it has been determined that the level of learning of the first learning value Toff_LRN1 is low, the learning promotion control processing forcefully controls the running state of the engine 3 such that the predetermined learning conditions described above (steps 11 to 14 of FIG. 5) are established in order to promote learning.

In the present processing, first, at step 41, determination is made as to whether or not the valve-close delay time learned flag F_LRN_OK is "1". When the determination result is YES and it has been determined that the level of learning of the first learning value Toff_LRN1 is high, the present processing ends as-is.

When the determination result of step 41 above is NO and it has been determined that the level of learning of the first learning value Toff_LRN1 is low, processing proceeds to step 42 and determination is made as to whether or not an idle running flag F idle is "1". When the determination result is a NO and the engine 3 is not in an idle running state, the present processing ends as-is.

When the determination result of step 42 above is YES, the valve-open time Ti of the fuel injection valve 10 is set to a predetermined learning value Ti_LRN of the predetermined value ΔTref or greater (step 43), and the fuel pressure PF is set to a predetermined learning value PF_LRN between the first and second predetermined values T1 and T2 (step 44). Further, the ignition timing IG is set to a predetermined learning value IG_LRN at the lag-angle side of an ordinary value in the idle running state (step 45). Furthermore, the throttle valve opening amount TH is controlled such that the engine revolutions NE becomes a predetermined learning value NE LRN, which is no greater than the predetermined value NEref (step 46), and the present processing ends.

According to the control above, the learning conditions of the first learning value Toff_LRN1 are established by controlling four running parameters of the engine 3, including the fuel temperature Tfuel, to within respective predetermined ranges. Then, the first learning value Toff_LRN1 is computed in accordance with that fact that the learning conditions were determined to have been established by the processing (steps 11 to 14) of FIG. 5. The learning of the first learning value Toff_LRN1 is accordingly promoted and the level of learning thereof is increased.

Figure 9A:
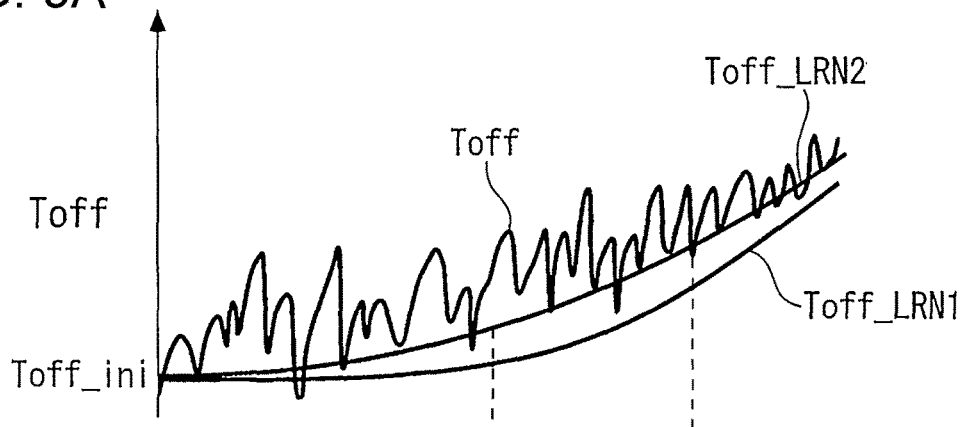
FIG. 9A is a timing chart schematically illustrating an operation example of an embodiment.
Figure 9B:
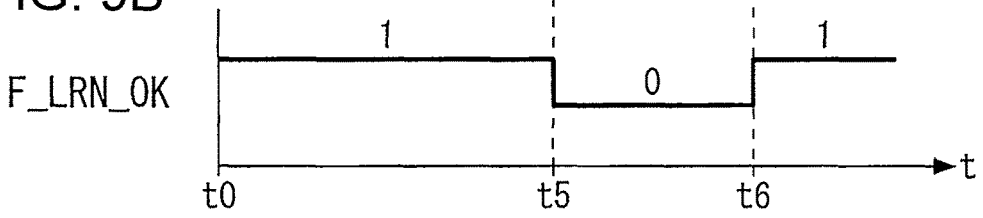
FIG. 9B is a timing chart schematically illustrating an operation example of an embodiment.

Next, an example of operation obtained by the embodiment described above is described, with reference to FIG. 9A and FIG. 9B. FIG. 9A and FIG. 9B schematically illustrate transitions of the valve-close delay time Toff, the first learning value Toff_LRN1, and the second learning value Toff_LRN2 from a new state when the fuel injection valve 10 has been used.

As described above, in the embodiment, the valve-close delay time Toff is computed each time the fuel injection valve 10 operates during running of the engine 3 (step 31 of FIG. 7). The computed valve-close delay time Toff reflects the characteristic of extending with age as the spring 13 of the fuel injection valve 10 deteriorates, and gradually increases from the initial value Toff_ini(t0) computed when the vehicle shipped. Further, the valve-close delay time Toff transitions in a variable state, since the valve-close delay time Toff changes in accordance with the running state of the engine 3 and is influenced by variation in the closing operation each time the fuel injection valve 10 operates, detection error, and the like.

Further, the second learning value Toff_LRN2 is always computed based on the valve-close delay time Toff, irrespective of whether or not the learning conditions have been established (step 32 of FIG. 7 and Equation (4)). Further, the second smoothing coefficient Gain2 employed in the computation is comparatively large, and the level of smoothing is therefore small. As a result of the above, transitions of the second learning value Toff_LRN2 are highly responsive to the valve-close delay time Toff.

On the other hand, the first learning value Toff_LRN1 is computed only in cases in which the learning conditions have been established, employing a stable and appropriate valve-close delay time Toff acquired under such conditions (FIG. 5, Equation (1)), and the actual valve-close delay time is therefore well reflected. Further, the first smoothing coefficient Gain1 employed in the computation of the first learning value Toff_LRN1 is comparatively small, and the corresponding level of smoothing is therefore high. A stable first learning value Toff_LRN1 is thereby obtained while suppressing variation and momentary fluctuations in the valve-close delay time Toff.

Further, in cases in which the computation frequency of the first learning value Toff_LRN1 falls as a result of the learning conditions rarely being established, when the learning value difference ΔToff between the second learning value Toff_LRN2 and the first learning value Toff_LRN1 has reached the determination value ΔTref or greater (t5), it is determined that the level of learning of the first learning value Toff_LRN1 is low and the valve-close delay time learned flag F_LRN_OK is set to "0".

As a result, the warning light 31 is illuminated and the learning promotion control of FIG. 8 is executed such that the learning conditions are established and learning is promoted by computing the first learning value Toff_LRN1. Then, when the learning value difference ΔToff has fallen below the determination value ΔTref (t6), it is determined that the level of learning of the first learning value Toff_LRN1 has recovered and the valve-close delay time learned flag FL_RN_OK is set to "1".

As described above, according to the present embodiment, each time the fuel injection valve 10 operates, the valve-close delay time Toff of the operation is computed. Further, the predetermined learning conditions are established when the valve-open time Ti of the fuel injection valve 10, the fuel temperature Tfuel, the engine revolutions NE, and the fuel pressure PF are in their respective predetermined ranges, and the first learning value Toff_LRN1 is computed based on the valve-close delay time Toff computed at that time. Then, the valve-open time Ti can be computed with good precision while excellently reflecting the actual valve-close delay time, since the valve-open time Ti is computed using the first learning value Toff_LRN1 computed in this manner.

Further, the second learning value Toff_LRN2 is always computed based on the valve-close delay time Toff, irrespective of whether or not the learning conditions above have been established, and the learning state of the first learning value Toff_LRN1 is determined based on the relationship between the computed first learning value Toff_LRN1 and second learning value Toff_LRN2. This enables the computation of the first learning value Toff_LRN1 of the valve-close delay time to be performed with good precision while ascertaining the learning state. Accordingly, the valve-open time Ti is computed with good precision using the first learning value Toff_LRN1, enabling the fuel injection quantity Qfuel to be controlled with good precision, and this enables the exhaust gas characteristics and the fuel consumption to be improved.

More specifically, in the determination of the learning state of the first learning value Toff_LRN1, when the learning value difference ΔToff, which is the difference between the second learning value Toff_LRN2 and the first learning value Toff_LRN1, reaches the predetermined determination value ΔTref or greater, it is determined that the level of learning of the first learning value Toff_LRN1 is low. This enables the level of learning of the first learning value Toff_LRN1 to be determined appropriately in accordance with the level of divergence from the second learning value Toff_LRN2.

Furthermore, when the first learning value Toff_LRN1 is computed, since the first smoothing coefficient Gain1, which has a high level of smoothing on the valve-close delay time Toff, is employed, a stable first learning value Toff_LRN1 can be obtained as the learning value for control, while suppressing the influence of variation and momentary fluctuations in the actual valve-close delay time, enabling the reliability of the first learning value Toff_LRN1 to be increased. On the other hand, when the second learning value Toff_LRN2 is computed, since the second smoothing coefficient Gain2, which has a low level of smoothing on the valve-close delay time Toff, is employed, it can be ensured that the second learning value Toff_LRN2 serving as the learning value for determination is highly responsive while suppressing the influence of variation of the valve-close delay time and the like to some extent.

Further, when it has been determined that the level of learning of the first learning value Toff_LRN1 is low, the learning promotion control of FIG. 8 is forcefully executed so that the running state of the engine 3 fulfills the learning conditions, and the first learning value Toff_LRN1 is computed in accordance therewith. This promotes learning of the first learning value Toff_LRN1 and enables the reliability of the first learning value Toff_LRN1 to be recovered by increasing the level of learning thereof. Furthermore, when it has been determined that the level of learning of the first learning value Toff_LRN1 is low, this situation can be effectively made known by illuminating the warning light 31 and required measures can be taken in response to the warning.

Note that the present disclosure is not limited to the embodiment described; various modes can be implemented. For example, in the embodiment, the learning value difference ΔToff, which is the difference between the first learning value Toff_LRN1 and the second learning value Toff_LRN2, is employed as a parameter representing the level of divergence of the first learning value Toff_LRN1 from the second learning value Toff_LRN2; however, another appropriate parameter that excellently represents the level of divergence may be employed, such as the ratio of the two or the reciprocal of the ratio.

Further, in the embodiment, the first smoothing coefficient Gain1 employed in the computation of the first learning value Toff_LRN1 is set to a smaller value and the second smoothing coefficient Gain2 employed in the computation of the second learning value Toff_LRN2 is set to a larger value; however, the first and second smoothing coefficients Gain1 and Gain2 may be set to the same value as each other, such that the level of smoothing is made equal.

Furthermore, in the embodiment, the first learning value Toff_LRN1 and the second learning value Toff_LRN2, computed using weighted averages according to Equation (1) and Equation (4) respectively, are compared to determine the level of learning of the first learning value Toff_LRN1. The present disclosure is not limited thereto. For example, an integrated value of values obtained by multiplying the valve-close delay time Toff acquired when the learning conditions are established by the first smoothing coefficient Gain1 may be compared against an integrated value of values acquired by multiplying the acquired valve-close delay time Toff by the second smoothing coefficient Gain2 irrespective of whether the learning conditions are established.

Further, in the embodiment, when it has been determined that the level of learning of the first learning value Toff_LRN1 is low, learning promotion control is executed to promote the learning; however, some other appropriate control may be performed in addition or instead. For example, computation of the valve-open time Ti may employ a corrected value of the first learning value Toff_LRN1 or an appropriate predetermined value, without employing the first learning value Toff_LRN1 as-is.

Further, the embodiment is an example in which the present disclosure was applied to a gasoline engine for a vehicle; however, the disclosure is not limited thereto. For example, the disclosure can be applied to another form of engine, for example, a diesel engine, or an engine having another application, for example a ship propeller engine such as an outboard motor disposed with the crankshaft along the vertical direction. Further, although the embodiment is an example of an engine having four cylinders, the number of cylinders may be freely selected, and it is obvious that a single cylinder engine may be employed. Other appropriate modifications can also be made to the configuration details within the scope of the disclosure.

A first aspect of the present disclosure describes an internal combustion engine control device that controls a quantity of fuel injected from a fuel injection valve having a valve-close delay time spanning from receipt of a valve-close instruction until actually closing, the internal combustion engine control device including: a valve-close delay time acquisition unit that acquires the valve-close delay time; a first learning value computation unit that, when a predetermined learning condition based on a running state of the internal combustion engine has been established, based on the acquired valve-close delay time computes a first learning value for control; a valve-open time computation unit that uses the computed first learning value to compute a valve-open time of the fuel injection valve; a second learning value computation unit that based on the acquired valve-close delay time always computes a second learning value for determination irrespective of whether or not the predetermined learning condition is established; and a learning state determination unit that determines a learning state of the first learning value based on a relationship between the computed first learning value and second learning value.

According to this internal combustion engine control device, the valve-close delay time of the fuel injection valve (time spanning from receipt of a valve-close instruction until actual closing) is acquired. Moreover, when the predetermined learning condition based on the running state of the internal combustion engine is established, the first learning value for control is computed based on the acquired valve-close delay time. As described later, the characteristics of the valve-close delay time of the fuel injection valve are such that the valve-close delay time changes depending on the specific running state of the of the internal combustion engine, and when the running state deviates from a certain condition, the valve-close delay time becomes unstable, or the amount of change becomes great. Accordingly, such conditions for the running state are set as the learning condition and only appropriate, stable valve-close delay times are used to compute the first learning value with good precision that excellently reflects the actual valve-close delay time by computing the first learning value of the valve-close delay time when the learning condition is established. This enables highly precise learning to be ensured.

Then, the valve-open time can be computed with good precision while the actual valve-close delay time is favorably reflected since the valve-open time of the fuel injection valve is computed using the first learning value computed in this manner.

Further, in the control device of the disclosure, the second learning value for determination is always computed based on the acquired valve-close delay time, irrespective of whether or not the learning condition is established. The always computed second learning value is thus highly responsive to the valve-close delay time compared to the first learning value. The learning state of the first learning value can therefore be appropriately determined based on the relationship between the computed first learning value and second learning value. As described above, according to the disclosure, learning of the valve-close delay time of the fuel injection valve can be performed with good precision while ascertaining the learning state. Accordingly, the valve-open time is computed with good precision using the learned valve-close delay time and the fuel injection quantity can be controlled with good precision, thereby enabling the exhaust gas characteristics and fuel consumption to be improved.

In a second aspect of the present disclosure, configuration may be made such that in the internal combustion engine control device of the first aspect, the learning state determination unit determines that a level of learning of the first learning value is low when a level of divergence of the first learning value from the second learning value is a predetermined value or greater.

The level of divergence of the first learning value from the second learning value computed as described above represents the level of learning of the first learning value. Accordingly, when the level of divergence is the predetermined value or greater, this configuration enables appropriate determination of when the level of learning of the first learning value is low as a result of the learning conditions being established becoming less frequent.

In a third aspect of the present disclosure, in the internal combustion engine control device of the first or second aspect, configuration may be made such that the first learning value computation unit computes the first learning value by subjecting the acquired valve-close delay time to first smoothing processing, and the second learning value computation unit computes the second learning value by subjecting the acquired valve-close delay time to second smoothing processing having a lower level of smoothing than the first smoothing processing.

According to this configuration, when the first learning value is computed, the acquired valve-close delay time is subjected to the first smoothing processing having a comparatively high level of smoothing. This enables a stable first learning value to be obtained as a learning value for control while suppressing the influence of variation and momentary fluctuations of the actual valve-close delay time, and this enables the reliability of the first learning value to be increased. On the other hand, when the second learning value is computed, the valve-close delay time is subjected to the second smoothing processing that has a lower level of smoothing than the first smoothing processing. This enables high responsiveness of the second learning value, as the learning value for determination, to be ensured while suppressing the influence of variation and the like of the valve-close delay time to some extent.

In a fourth aspect of the present disclosure, the internal combustion engine control device of the second or third aspect may further include a running state controlling unit that, when the learning state determination unit has determined that the level of learning of the first learning value is low, controls a running state of the internal combustion engine such that the predetermined learning condition is established.

In this configuration, the running state of the internal combustion engine is forcefully controlled such that the predetermined learning condition is established when it has been determined that the level of learning of the first learning value is low. This control causes the running state of the internal combustion engine to fulfill the learning condition, and the first learning value is computed in accordance with the learning condition being established. This enables learning of the first learning value to be promoted and enables the reliability of the first learning value to recover by increasing the level of learning.

In a fifth aspect of the present disclosure, the internal combustion engine control device of any one of the second aspect to the fourth aspect may further include a warning unit that warns that a situation has occurred in which the learning state determination unit has determined that the level of learning of the first learning value is low.

This configuration enables the situation to be made known effectively by the warning by the warning unit when it has been determined that the level of learning of the first learning value is low. Further, required measures can be taken in response to the warning.

Obviously, numerous modifications and variations of the present invention are possible in light of the above teachings. It is therefore to be understood that within the scope of the appended claims, the invention may be practiced otherwise than as specifically described herein.

What is claimed is:

1. An internal combustion engine control device that controls a quantity of fuel injected from a fuel injection valve having a valve-close delay time spanning from receipt of a valve-close instruction until actually closing, the internal combustion engine control device comprising:

a valve-close delay time acquisition unit that acquires the valve-close delay time;

a first learning value computation unit that, when a predetermined learning condition based on a running state of the internal combustion engine has been established, based on the acquired valve-close delay time computes a first learning value for control;

a valve-open time computation unit that uses the computed first learning value to compute a valve-open time of the fuel injection valve;

a second learning value computation unit that based on the acquired valve-close delay time always computes a second learning value for determination irrespective of whether or not the predetermined learning condition is established; and a learning state determination unit that determines a learning state of the first learning value based on a relationship between the computed first learning value and second learning value.

2. The internal combustion engine control device according to claim 1, wherein the learning state determination unit determines that a level of learning of the first learning value is low when a level of divergence of the first learning value from the second learning value is a predetermined value or greater.

3. The internal combustion engine control device according to claim 2, further comprising a running state controlling unit that, when the learning state determination unit has determined that the level of learning of the first learning value is low, controls a running state of the internal combustion engine such that the predetermined learning condition is established.

4. The internal combustion engine control device according to claim 2, further comprising a warning unit that warns that a situation has occurred in which the learning state determination unit has determined that the level of learning of the first learning value is low.

5. The internal combustion engine control device according to claim 1, wherein the first learning value computation unit computes the first learning value by subjecting the acquired valve-close delay time to first smoothing processing, and the second learning value computation unit computes the second learning value by subjecting the acquired valve-close delay time to second smoothing processing having a lower level of smoothing than the first smoothing processing.

6. An internal combustion engine control device to control a fuel injection valve, comprising:

valve-close delay time acquisition circuitry configured to acquire a valve-close delay time of the fuel injection valve;

first learning value calculation circuitry configured to calculate a first learning value based on the valve-close delay time when a running state of an internal combustion engine satisfies a predetermined learning condition;

valve-open time calculation circuitry configured to calculate a valve-open time of the fuel injection valve based on the first learning value;

second learning value calculation circuitry configured to calculate a second learning value based on the valve-close delay time irrespective of the running state of the internal combustion engine; and learning state determination circuitry configured to determine a learning state of the first learning value based on a relationship between the first learning value and second learning value.

7. The internal combustion engine control device according to claim 6, wherein the learning state determination circuitry determines that a level of learning of the first learning value is low when a level of divergence of the first learning value and the second learning value is a predetermined value or greater.

8. The internal combustion engine control device according to claim 7, further comprising a running state controlling circuitry configured to control the running state of the internal combustion engine such that the predetermined learning condition is satisfied when the level of learning of the first learning value is low.

9. The internal combustion engine control device according to claim 7, further comprising a warning circuitry configured to warn that the level of learning of the first learning value is low.

10. The internal combustion engine control device according to claim 6, wherein the first learning value calculation circuitry calculates the first learning value by subjecting the valve-close delay time to first smoothing processing, and the second learning value calculation circuitry calculates the second learning value by subjecting the valve-close delay time to second smoothing processing having a lower level of smoothing than the first smoothing processing.

11. An internal combustion engine control device to control a fuel injection valve, comprising:

valve-close delay time acquisition means for acquiring a valve-close delay time of the fuel injection valve;

first learning value calculation means for calculating a first learning value based on the valve-close delay time when a running state of an internal combustion engine satisfies a predetermined learning condition;

valve-open time calculation means for calculating a valve-open time of the fuel injection valve based on the first learning value;

second learning value calculation means for calculating a second learning value based on the valve-close delay time irrespective of the running state of the internal combustion engine; and learning state determination means for determining a learning state of the first learning value based on a relationship between the first learning value and second learning value.

12. A method for controlling a fuel injection valve of an internal combustion engine, comprising:

acquiring a valve-close delay time of the fuel injection valve;

calculating a first learning value based on the valve-close delay time when a running state of an internal combustion engine satisfies a predetermined learning condition;

calculating a valve-open time of the fuel injection valve based on the first learning value;

calculating a second learning value based on the valve-close delay time irrespective of the running state of the internal combustion engine; and determining a learning state of the first learning value based on a relationship between the first learning value and second learning value.

* * * * *